United States Patent [19]

Ikeda et al.

[11] Patent Number: 4,985,350

[45] Date of Patent: Jan. 15, 1991

[54] SILVER HALIDE PHOTOGRAPHIC LIGHT-SENSITIVE MATERIAL

[75] Inventors: Hideo Ikeda; Shingo Ishimaru, both of Minami-Ashigara, Japan

[73] Assignee: Fuji Photo Film Co., Ltd., Minami-Ashigara, Japan

[21] Appl. No.: 471,679

[22] Filed: Jan. 25, 1990

Related U.S. Application Data

[63] Continuation of Ser. No. 199,189, May 26, 1988, abandoned.

[30] Foreign Application Priority Data

Jun. 1, 1987 [JP] Japan ..... 62-137943

[51] Int. Cl.[5] ..... G03C 1/035

[52] U.S. Cl. ..... 430/567; 430/569; 430/599

[58] Field of Search ..... 430/567, 569, 599

[56] References Cited

U.S. PATENT DOCUMENTS 4,614,711 9/1986 Sugimoto et al. ..... 430/567

4,665,012 6/1987 Sugimoto et al. ..... 430/567

*Primary Examiner*—Paul R. Michl

*Assistant Examiner*—Janet C. Baxter

*Attorney, Agent, or Firm*—Burns, Doane, Swecker & Mathis

[57] ABSTRACT

A silver halide photographic light-sensitive material includes a support having thereon at least one silver halide light-sensitive emulsion layer, characterized in that at least one of a plurality of emulsions contained in the emulsion layer contains tabular grains having a thickness of less than 0.5 μm, a diameter of at least 0.3 μm, and an average ratio of grain diameter to grain thickness of at least 2, the tabular grains occupy at least 50% of the entire projected area of all the grains contained in the emulsion, the surfaces of the grains are chemically sensitized, and a ratio of surface sensitivity to internal sensitivity of the grains is 0.5 to 2.

8 Claims, No Drawings

SILVER HALIDE PHOTOGRAPHIC LIGHT-SENSITIVE MATERIAL

This is a continuation of application Ser. No. 07/199,189, filed May 26, 1988, abandoned.

BACKGROUND OF THE INVENTION

1. Field of the Invention

The present invention relates to a silver halide photographic light-sensitive material having improved image sharpness and resistance to stress.

2. Description of the Related Art

Normally, in a photographic light-sensitive material comprising a silver halide emulsion layer, light scattering caused by silver halide grains tends to reduce the sharpness of the emulsion layer.

U.S. Pat. Nos. 4,434,226, 4,439,520, and 4,433,048 describe that image sharpness and the like can be improved by use of a tabular silver halide emulsion and that this technique can be applied to a photographic light-sensitive material.

However, tabular silver halide grains have poor resistance to stress, and form many stress marks and therefore results in difficulties in designing photographic light-sensitive material, as will be explained below.

More precisely, a photographic light-sensitive material on which is coated a silver halide emulsion is subjected to a variety of stresses when in the form of a conventional photographic negative film; being rolled up inside a cartridge, bent when it is inserted into a camera, and pulled when it is wound and re-wound.

On the other hand, a sheet-like film such as a light-sensitive print material or a roentgen light-sensitive material for medical and direct X-ray often becomes bent or folded on account of it being handled directly by an operator.

In addition to the above, all light-sensitive materials are subjected to high stress when cut and during manufacture.

When a photographic light-sensitive material is subjected to such stress, silver halide grains are stressed through gelatin which is a binder of the silver halide grains, or through a plastic film which acts as a support therefor. When the silver halide grains undergo such stress, the photographic properties of the photographic light-sensitive material are changed, as is described in detail in K.B. Mather, J. Opt. Soc. Am., 38, 1054 (1948), P. Faelens and P. de Smet, Sci. et Ind. Phot., 25, No. 5. 178 (1954) P. Faelens. J. Phot. Sci, 2, 105 (1954).

Consequently, there is widespread demand for a photographic light-sensitive material whose photographic properties are not adversely affected by any type of stress.

In order to improve resistance to stress, a plasticizer such as a polymer or emulsion is added, or the ratio of silver halide to gelatin in the silver halide emulsion is reduced so that no stress reaches the grains.

For example, British Patents Nos. 738,618, 738,637, and 738,639 disclose methods of using a heterocyclic compound, alkylphthlate, and alkylester, respectively; U.S. Pat. Nos. 2,960,404 and 3,121,060 disclose methods of using polyhydric alcohol and carboxyalkylcellulose, respectively; JP-A-49-5017 discloses a method of using paraffin and a carbonic acid salt; and JP-B-53-28086 discloses a method of using alkylacrylate and an organic acid. Hereinafter, the symbol "JP-A-" will be used to denote a Japanese Patent Disclosure, and the symbol "JP-B-" will be used to designate a Japanese Patent Publication. Further, the symbol "JP-A-(examined)" will be used to specify a published Japanese patent application without having been laid open which was filed before Jan. 1, 1971 when the system of laying open any patent application came into existence.

However, since mechanical strength of an emulsion layer is reduced when a plasticizer is added, the amount of the plasticizer which can be used limited. In addition, when the amount of gelatin is increased, sharpness is degraded or a developing speed is reduced. Therefore, neither of these methods can achieve a sufficient effect.

As a method of improving resistance to stress of the tabular silver halide grain itself, JP-A-59-99433 discloses a method of forming an iodide rich annular region inside a grain.

Although resistance to stress can be improved by this method, further improvements are desired.

SUMMARY OF THE INVENTION

It is an object of the present invention to provide a silver halide photographic light-sensitive material having excellent image sharpness and resistance to stress.

The above object of the present invention has been achieved by a silver halide photographic light-sensitive material comprising a support having thereon at least one light-sensitive material silver halide emulsion layer, characterized in that at least one of a plurality of emulsions contained in the emulsion layer contains tabular grains having a thickness of less than 0.5 μm, a diameter of at least 0.3 μm, and an average ratio of grain diameter to grain thickness of at least 2, the tabular grains occupy at least 50% of projected area of all grains contained in the emulsion, the surfaces of said grains are chemically sensitized, and a ratio of surface sensitivity to internal sensitivity of said grains is 0.5 to 2.

In this case, the surface sensitivity and the internal sensitivity are defined by the following equation with respect to surface development (A) and internal development (B), respectively, after an emulsion or emulsion coated material is exposed for 1 to 1/100 seconds:

$$S=100/Eh$$

where S is sensitivity and Eh is an exposure amount required for obtaining a density of (Dmax+Dmin)/2 which is a central value between maximum density (Dmax) and minimum density (Dmin).

SURFACE DEVELOPMENT (A)

The material is developed in a developer having the following composition at a temperature of 20° C. for 10 minutes.

| | |
|---|---|
| N-methyl-p-aminophenol (hemisulfate) | 2.5 g |
| Ascorbic Acid | 10 g |
| Sodium Metaborate Tetrahydrate | 35 g |
| Potassium Bromide | 1 g |
| Water to make | 1 liter |

INTERNAL DEVELOPMENT (B)

The material is processed in a bleaching solution containing 3g/l of red prussiate and 0.0126 g/l of phenosafnine at about 20° C. for 10 minutes, washed with water for 10 minutes, and then developed in a developer having the following composition at 20° C. for 10 minutes.

| | |
|---|---|
| N-methyl-p-aminophenol (hemisulfate) | 2.5 g |
| Ascorbic Acid | 10 g |
| Sodium Metaborate Tetrahydrate | 35 g |
| Potassium Bromide | 1 g |
| Soda Thiosulfate | 3 g |
| Water to make | 1 liter |

The present invention will be described below in detail.

DETAILED DESCRIPTION OF THE PREFERRED EMBODIMENTS

The resistance to stress of the tabular silver halide grain is degraded because, e.g., a tabular grain tends to deform by stress as compared with a grain having a large thickness. Stress electrons are generated by this deformation and trapped in a surface site, thereby generating stress marks. In order to eliminate this drawback, the present inventors have made extensive studies and found that it is definitely important that the tabular emulsion holds predetermined internal sensitivity after the grain surface is chemically sensitized.

In order to achieve such the internal sensitivity, chemical sensitization, doping of metal ions which trap electrons, or introducing of a halogen composition distribution into a grain so as to generate lattice dislocation—each being performed before desired silver halide grains were formed—was effective.

In this invention, tabular silver halide grains (to be referred to as "tabular grains") have two opposing parallel major faces whose diameter (diameter of a circle having the same area as the projected area of the major faces) is twice or more the distance between the major faces (i.e., a thickness of a grain).

A mean ratio of grain diameter to grain thickness to be referred to as "mean grain diameter/thickness ratio" of the tabular grains, according to this invention in the emulsion is preferably 3 to 12, and more preferably, 5 to 10.

A mean grain diameter/thickness ratio can be obtained by averaging the grain diameter/thickness ratios of all the tabular grains. However, this can be obtained more easily as a ratio of a mean diameter to a mean thickness of all the tabular grains.

The diameter of the tabular grains in this invention (diameter of a circle having the same area as the projected area of the tabular grains) is 0.3 to 10 μm, preferably, 0.5 to 5.0 μm, and more preferably, 0.5 to 2.0 μm. The grain thickness is 0.5 μm or less, preferably, 0.05 to 0.5 μm, and preferably, 0.08 to 0.3 μm.

Diameter and thickness of the grains in this invention can be measured by an electron microscopic photograph of grains as described in U.S. Pat. No. 4,434,226. Examples of a halogen composition of the tabular grain are silver chloroiodide, silver iodobromide, silver chloride, silver chlorobromide, silver bromide, and silver chloroiodobromide. Silver thiocyanate or silver cyanate may be included.

The above-mentioned grains having a thickness of less than 0.5 μm, a diameter of 0.3 μm or more, and an average grain diameter/thickness ratio of 2 or more must occupy 50% or more, preferably 70% or more, of the entire projected surface area of the grains in the emulsion. In the emulsion layer, the above grains preferably occupy 30% or more, and more preferably, 50% or more of the entire projected surface area of the all grains.

The tabular grain can be manufactured by combining methods described in, e.g., U.S. Pat. Nos. 4,434,226, 4,439,520, 4,414,310, 4,399,215, 4,433,048, 4,386,156, 4,400,463, 4,414,306, and 4,435,501.

For example, a seed crystal in which tabular grains exist in an amount of 40 wt % is formed in an atmosphere having a relatively high pAg value with a pBr of 1.3 or less. Then, a solution of silver ion and a solution of halide ion are added to the seed crystal while maintaining the above pBr value or more to grow the seed crystal, thereby forming tabular grains.

In a grain growth process performed by adding silver and/or halide, preferably, a solution of silver and a solution of halide are carefully added to the seed crystal so that a new crystal nucleus is not generated.

The size of the tabular grains can be adjusted by controlling a temperature, selecting a type and an amount of a solvent, and controlling the addition speed of a silver salt and a halide used in the grain growth process.

The internal sensitivity after the surface of the tabular grain of the present invention is chemically sensitized can be increased by performing chemical sensitization before completion of grain formation. It is preferred to perform chemical sensitization before 80% of the total silver amount of the grains is consumed.

This chemical sensitization can be performed by using active gelatin, as described in T.H. James, The Theory of the Photographic Process, 4th ed., Macmillan (1977), 67–76. The chemical sensitization can also be (1977), performed by using sulfur, selenium, tellurium, gold, platinum, palladium, and iridium or a combination of a plurality of these sensitizing agents in an atmosphere in which a pAg is 5 to 10, a pH is 5 to 8 and a temperature is 30° to 80° C. as described in Research Disclosure, Vol. 120, No. 12008 (Apr. 1974); Research Disclosure, Vol. 34, No. 13452 (June 1975), U.S. Pat. Nos. 2,642,361, 3,297,446, 3,772,031, 3,857,711, 3,901,714, 4,266,018, and 3,904,415, and British Patent No. 1,315,755. The chemical sensitization is optimally performed in the presence of gold and thiocyanate compounds, or in the presence of sulfur-containing compounds described in U.S. Pat. Nos. 3,857,711, 4,266,018, and 4,054,457 or a sulfur-containing compound such as hypo, a thiourea series compound, or a rhodanic series compound. Chemical sensitization can be performed also in the presence of a chemical sensitizing aid. An example of a chemical sensitizing aid is a compound such as azaindene, azapyridazine, and azapyrimidine which is known to reduce a fog and increase sensitivity in a chemical sensitizing process. Examples of chemical sensitization modifiers are described in U.S. Pat. Nos. 2,131,038, 3,411,914, and 3,554,757, JP-A-58-126526, and G.F. Duffin, Photographic Emulsion Chemistry, 38–143. In addition to, or in place of, chemical sensitization, reduction sensitization can be performed using hydrogen as described in U.S. Pat. Nos. 3,891,446 and 3,984,249, using stannous chloride, thiourea dioxide, polyamine and such a reducing agent as described in U.S. Pat. Nos. 2,518,698, 2,743,182, and 2,743,183, or by a low pAg (e.g., less than 5) and/or high pH (e.g., more than 8) treatment. Chemical sensitization methods described in U.S. Pat. Nos. 3,917,485 and 3,966,476 can be applied.

Furthermore, the sensitization method using an oxidizing agent described in JP-A-61-3134 or JP-A-61-3136 can also be used.

As another method of increasing the internal sensitivity, a gap of a halogen composition may be introduced before completion of grain formation. In this case, it is also preferred to introduce the gap before 80% of the total silver amount of the grains is consumed.

As the gap of the halogen composition is increased, the internal sensitivity is increased. For example, when silver iodobromide is to be used, the difference in silver iodide content is preferably 5 mol% or more, and more preferably, 10 mol% or more.

In this invention, the following mono-dispersed hexagonal tabular grains can be used.

The emulsion is a silver halide emulsion containing a dispersion medium and silver halide grains. In this emulsion, 70% or more of the entire projected area of the silver halide grains is occupied by tabular silver halide grains which are hexagons in which a ratio of a length of an edge having a maximum length to a length of an edge having a minimum length is 2 or less and which have two parallel faces as outer surfaces. This emulsion is a mono-dispersion emulsion, i.e., a variation coefficient of a grain size distribution of the hexagonal tabular silver halide grains is 20% or less. The variation coefficient is a value obtained by dividing a variation (standard deviation) of a grain size, which is represented by a diameter of a circle having the same area as the projected area of the grains, by the average grain size. The aspect ratio is 2.5 or more, and a grain size is 0.2 μm or more.

A composition of the hexagonal tabular grains may be any of silver bromide, silver iodobromide, silver chlorobromide, and silver iodochlorobromide. If iodide ions are included, their content is 0 to 30 mol%. The crystal structure may be any of a uniform structure, a structure whose inner portion is of a halide composition different from that of an outer portion, and a layer structure. A reduction sensitized silver nucleus is preferably contained in the grains.

The silver halide grains can be manufactured through nucleus formation, Ostwald ripening, and grain growth in accordance with a method known in the art.

During manufacture of the tabular grains of this invention, a method of increasing the addition speed, addition amount, and addition concentration of silver solution (e.g., an aqueous $AgN_{03}$ solution) and halide solution (e.g., an aqueous KBr solution) to be added to accelerate grain growth is preferably used.

Examples of this method are described in British Patent No. 1,335,925, U.S. Pat. Nos. 3,672,900, 3,650,757, and 4,242,445, JP-A-55-142329 and JP-A-55-158124.

A solvent for silver halide is effective to promote ripening. For example, in order to promote ripening, an excessive amount of halide ions is supplied into a reaction vessel. Therefore, it is clear that ripening can be promoted by only supplying a solution of a salt of a halide into the reaction vessel. Other ripening agents may also be used. These ripening agents may be entirely mixed in a dispersion medium in the reaction vessel before the salt of silver and the salt of halide are added, or may be supplied into the reaction vessel together with 1 or more salts of halides, salts of silver, or deflocculating agents. As another modification, the ripening agents may be independently supplied when a salt of halide and salt of silver are added.

Examples of the ripening agent other than halide ions are ammonia, amine compound, thiocyanate such as an alkali metal thiocyanate, especially sodium or potassium thiocyanate, and ammonium thiocyanate. Methods of using a thiocyanate ripening agent are described in U.S. Pat. Nos. 2,222,264, 2,448,534, and 3,320,069. A conventional thioether ripening agent can be used as described in U.S. Pat. Nos. 3,271,157, 3,574,628, and 3,737,313. A thionic compound as disclosed in JP-A-53-82408 and JP-A-53-144319 can also be used.

By supplying a variety of compounds during silver halide precipitation, certain characteristics of the silver halide grains can be controlled. Such compounds may be initially supplied in the reaction vessel or may be added together with 1 or more of salts in accordance with a conventional method. As described in U.S. Pat. Nos. 2,448,060, 2,628,167, 3,737,313, and 3,772,031 and Research Disclosure, Vol. 134, No. 13452 (June 1975), compounds of copper, iridium, lead, bismuth, cadmium, zinc, (a chalcogenide of sulfur, selenium, tellurium or the like), and compounds of gold, and noble metals of Group VII may be supplied in the silver halide precipitation to control the characteristics of the silver halide. As described in Japanese Patent Publication No. 58-1410 and Moisar et al., Journal of Photographic Science, Vol. 25, 19–27 (1977), the interiors of the grains of the silver halide emulsion can be subjected to reduction sensitization during precipitation.

In the tabular grains used in this invention, silver halides having different compositions may be bonded to each other by an epitaxial junction or a silver halide may be bonded to a compound other than silver halides, such as silver rhodanide or lead oxide. Such emulsion grains are disclosed in, for example, U.S. Pat. Nos. 4,094,684, 4,142,900, and 4,459,353, British Patent No. 2,038,792, U.S. Pat. Nos. 4,349,622, 4,395,478, 4,433,501, 4,463,087, 3,656,962, and 3,852,067, and JP-A-59-162540.

The surface of the tabular grain of the present invention must be chemically sensitized. This is because sufficient sensitivity cannot be obtained with a normal surface development developer due to high internal sensitivity.

As described in T.H. James, The Theory of the Photographic Process, 4th ed., Macmillan (1977), 67–76, chemical sensitization can be performed by using active gelatin. Chemical sensitization can also be performed by using sulfur, selenium, tellurium, gold, platinum, palladium, and iridium or a combination of a plurality of these sensitizing agents, in an atmosphere in which the pAg is 5 to 10, a pH is 5 to 8 and the temperature is 30° to 80° C. as described in Research Disclosure, Vol. 120, No. 12008 (apr. 1974); Research Disclosure, Vol. 34, No. 13452 (June 1975), U.S. Pat. Nos. 2,642,361, 3,297,446, 3,772,031, 3,857,711, 3,901,714, 4,266,018, and 3,904,415, and British Pat. No. 1,315,755. Chemical sensitization is optimally performed in the presence of gold and thiocyanate compounds, or in the presence of sulfur-containing compounds described in U.S. Pat. Nos. 3,857,711, 4,266,018, and 4,054,457 or a sulfur-containing compound such as hypo, a thiourea series compound, or a rhodanic series compound. Chemical sensitization can be performed also in the presence of a chemical sensitizing aid. An example of a chemical sensitizing aid is a compound such as azaindene, azapyridazine, or azapyrimidine which is known to reduce a fog and increase sensitivity in a chemical process. Examples of a chemical sensitizing aid modifier are described in U.S. Pat. Nos. 2,131,038, 3,411,914, and 3,554,757, JP-A-58-126526, and G.F. Duffin, Photographic Emulsion Chemistry, 138-143. Reduction sensitization alone can be performed using hydrogen as described in U.S. Pat. Nos. 3,891,446 and 3,984,249, using stannous chloride, thiourea dioxide, polyamine and such a reducing agent as described in U.S. Pat. Nos. 2,518,698, 2,743,182, and 2,743,183, or by a low pAg (e.g., less than 5) and/or high pH (e.g., more than 8) treatment. Spectral sensitization can be improved by the chemical sensitization methods described in U.S. Pat. No. 3,917,485 and 3,966,476.

Furthermore, the sensitization method using an oxidizing agent described in JP-A-61-3134 or JP-A-61-3136 can also be used.

The ratio of internal sensitivity to surface sensitivity of the emulsion of the present invention is 0.5 to 2. When the ratio is less than 0.5, sufficient sensitivity cannot be obtained. On the other hand, when the ratio exceeds 2, stress marks are increased.

The emulsion containing tabular grain of this invention can be used together with an emulsion containing silver halide grains (to be referred to as non-tabular grains hereinafter) which are subjected to normal chemical sensitization, in a single silver halide emulsion layer. Especially in a color photographic light-sensitive material, the tabular grain and non-tabular grain emulsions can be used in different emulsion layers and/or the single emulsion layer Examples of the non-tabular grains are regular grains having a regular crystal form such as cube, octahedron, tetradecahedron, and an irregular crystal form such as sphere, potato-like. Silver bromide, silver iodobromide, silver iodochlorobromide, silver chlorobromide, or silver chloride can be used as a silver halide in the non-tabular grains. A preferred silver halide is silver iodobromide or silver iodochlorobromide containing at most about 30 mol% of silver iodide. A particularly preferred silver halide is silver iodobromide containing about 2% to about 25% of silver iodide.

The non-tabular grains may be fine grains having grain sizes of not more than about 0.1 micron. They may be large grains as long as the diameter of their projected area does not exceed 10 microns or thereabouts. Also, the silver halide emulsion for use in this invention may be a mono-dispersed silver halide emulsion having a narrow grain size distribution or a poly-dispersed silver halide emulsion having a broad grain distribution.

The non-tabular grains for use in this invention can be prepared using the methods described, for example, in P. Glafkides, Chimie et Physique Photographique Paul Montel, published by Paul Montel, 1967; G.F. Duffin, Photographic Emulsion Chemistry, published by Focal Press, 1966; and V.L. Zelikman et al., Making and Coating Photographic Emulsion, published by Focal Press, 1964. That is, the photographic emulsion can be prepared by an acid method, a neutralization method, an ammonia method, etc. Also, as a system for reacting a soluble silver salt and a soluble halide, a single jet method, a double jet method, or a combination thereof may be used. Also, a so-called back mixing method for forming silver halide grains in the existence of excessive silver ions can be used. As one system of the double jet method, a so-called controlled double jet method wherein the pAg in the liquid phase of forming silver halide is kept at a constant value can be used. According to this method, a silver halide emulsion having a regular crystal form and almost uniform grain sizes is obtained.

Two or more kinds of silver halide emulsions separately prepared can be used as a mixture thereof.

The silver halide emulsion containing the abovedescribed regular silver halide grains can be obtained by controlling the pAg and pH during the formation of the silver halide grains. More particularly, such a method is described in Photographic Science and Engineering, Vol. 6, 159–165 (1962); Journal of Photographic Science, Vol. 12, 242–251 (1964); U.S. Pat. No. 3,655,394, and British Patent No. 1,413,748.

Mono-dispersed emulsions are described in JP-A48-8600, JP-A-51-39027, JP-A-51-83097, JP-A-53-137133, JP-A-54-48521, JP-A-54-99419, JP-A-58-37635, JP-A58-49938, JP-A(examined)-47-11386, U.S. Pat. No. 3,655,394, and British Patent No. 1,413,748.

As for the crystal structure of the silver halide for use in this invention, the non-tabular grains may be uniform, may have a different halide composition between the inside and the outside thereof, or may have a layer structure. These emulsion grains are disclosed in British Patent No. 1,027,146, U.S. Pat. Nos. 3,505,068 and 4,444,877.

In this invention, a non-light-sensitive fine grain emulsion having a grain size of at most 0.6μ, and preferably, at most 0.2μ may be added to a silver halide emulsion layer, an interlayer, or a protective layer for the purpose of promoting development, improving storage property, effectively utilizing reflected light, and the like.

The tabular grains of this invention are preferably used in a color light-sensitive material for photography.

When the tabular grain emulsion of this invention is used together with, especially, a non-tabular mono-dispersed silver halide grain emulsion in a single emulsion layer and/or different emulsion layers, sharpness and graininess can be improved at the same time.

In this case, the mono-dispersed silver halide emulsion (non-tabular grain) is defined such that 95% or more of a total weight or a total number of silver halide grains contained in the emulsion have grain sizes falling within the range of ±40%, and preferably, ±30% of a mean grain size. As described in JP-A(examined-47-11386, JP-A-55-142329, JP-A-57-17235, and JP-A-59-72440, graininess can be improved by using the mono-disposed silver halide emulsion in the silver halide photographic light-sensitive material. As described in T.H. James, The Theory of the Photographic Process, 580-585, mono-dispersed silver halide grains having sizes of 0.3 to 0.8μ have a high light scattering property with respect to light of a specific wavelength range but have a relatively low light scattering property with respect to light of other wavelength ranges.

Therefore, when the tabular silver halide emulsion having a grain diameter/thickness ratio of 5 or more and the mono-dispersed silver halide emulsion are properly arranged in consideration of the optical characteristics and graininess of both the emulsions, sharpness and graininess of the silver halide photographic light-sensitive material can be improved at the same time.

Some examples of a light-sensitive material using tabular and mono-dispersed silver halide emulsions will be described below.

Example 1: In a light-sensitive material in which red-sensitive, green-sensitive, and blue-sensitive layers are arranged in the order named from a support, if a mean grain size of silver halide grains contained in a silver halide emulsion layer constituting the blue-sensitive layer falls within the range of 0.3 to 0.8μ, the tabular grain emulsion is used as the emulsion layer, and if the mean grain diameter does not fall within the above range, the mono-dispersed silver halide emulsion is used. As a result, sharpness of the green- and red-sensitive layers and graininess of the blue-sensitive layer can be improved.

Example 2: In a light-sensitive material having a layer arrangement similar to that of Example 1, if a mean grain size of silver halide grains contained in a silver halide emulsion layer constituting the greensensitive layer falls within the range of 0.4 to 0.8 μ, the tabular grain emulsion is used as the emulsion layer, and if the mean grain size does not fall within the above range, the mono-dispersed emulsion is used. As a result, sharpness of the red-sensitive layer and graininess of the green-sensitive layer can be improved at the same time.

Example 3: In a light-sensitive material having a layer arrangement similar to that of Example 1 in which emulsion layers having the same color sensitivity consist of two or more layers having different sensitivities, if silver halide grains contained in the blue-sensitive layer having highest sensitivity are mono-dispersed silver halide grains (preferably, double structure grains) having a mean grain size of 1.0 μ or more and light scattering of a blue-sensitive layer having lower sensitivity is large, the tabular grain emulsion is used as the blue-sensitive layer having lower sensitivity. As a result, sharpness of the green and red-sensitive layers can be improved.

Example 4: In a light-sensitive material having a layer arrangement similar to that of Example 3, if all of a plurality of green-sensitive layers have large light scattering, the tabular grain emulsion is used as all the green-sensitive layers. As a result, sharpness of the red-sensitive layers and graininess of the greensensitive layers can be improved at the same time.

As in Examples 3 and 4, when each of the blue-, green-, and red-sensitive layers includes of a plurality of emulsion layers, the tabular grain emulsion must be used as emulsion layers having large light scattering and the mono-dispersed emulsion must be used as those having small light scattering so as to improve sharpness and graininess. When the tabular grain emulsion is used also in the red-sensitive layers in Example 4), light scattering between the emulsion layers is sometimes increased to degrade sharpness of the greensensitive layers on the red-sensitive layers. That is, it is not always preferable to use the tabular grain emulsion as the red-sensitive layer closest to the support.

As described above, the tabular and non-tabular grain emulsions for use in this invention are usually subjected to physical ripening, chemical ripening, and spectral sensitization. Additives which are used in such steps are described in Research Disclosures, RD No. 17643 and RD No. 18716 and they are summarized in the following table.

Also, photographic additives which can be used in this invention are described in the above-described two Research Disclosures publications and they are also summarized in the same table.

| Additives | RD No. 17643 | RD No. 18716 |
|---|---|---|
| 1. Chemical sensitizers | page 23 | page 648, right column |
| 2. Sensitivity increasing agents | | page 648, right column |
| 3. Spectral sensitizers, super sensitizers | pages 23–24 | page 648, right column to page 649, right column |
| 4. Brighteners | page 24 | |
| 5. Antifoggants and stabilizers | pages 24–25 | page 649, right column |
| 6. Light absorbent, filter dye, ultraviolet absorbents | pages 25–26 | page 649, right column to page 650, left column |
| 7. Stain preventing agents | page 25, right column | page 650, left to right columns |
| 8. Dye image stabilizers | page 25 | |
| 9. Hardening agents | page 26 | page 651, left column |
| 10. Binder | page 26 | page 651, left column |
| 11. Plasticizers, lubricants | page 27 | page 650, right column |
| 12. Coating aids, surface active agents | pages 26–27 | page 650, right column |
| 13. Antistatic agents | page 27 | page 650, right column |

In this invention, various color couplers can be used. Specific examples of these couplers are described in the above-described Research Disclosure, No. 17643, VII-C to VII-G as patent references.

Preferred examples of a yellow coupler are described in, for example, U.S. Pat. Nos. 3,933,501, 4,022,620, 4,326,024, and 4,401,752, JP-B-58-10739, British Patents Nos. 1,425,020 and 1,476,760.

Examples of a magenta coupler are preferably 5-pyrazolone series and pyrazoloazole series compounds, and more preferably, the compounds described in U.S. Pat. Nos. 4,310,619 and 4,351,897, European Patent No. 73,636, U.S. Pat. Nos. 3,061,432 and 3,752,067, Research Disclosure No. 24220 (June 1984), JP-A60-33552, Research Disclosure No. 24230 (June 1984), JP-A-60-43659, and U.S. Pat. Nos. 4,500,630 and 4,540,654.

Examples of a cyan coupler are phenol series and naphthol series couplers, and preferably, those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Application (OLS) No. 3,329,729, European Patent No. 121,365A, U.S. Pat. Nos. 3,446,622, 4,333,999, 4,451,559, and 4,427,767, and European Patent No. 161,626A.

Preferable examples of a colored coupler for correcting additional, undesirable absorption of colored dye are those described in Research Disclosure No. 17643, VII-G, U.S. Pat. Nos. 4,163,670, Japanese Patent Publication No. 57-39413, U.S. Pat. Nos. 4,004,929 and 4,138,258, and British Patent 1,146,368.

Preferable examples of a coupler capable of forming colored dyes having proper diffusibility are those described in U.S. Pat. No. 4,366,237, British Patent 2,125,570, European Patent No. 96,570, and West German Patent Application (OLS) No. 3,234,533.

Typical examples of a polymerized dye-forming coupler are described in U.S. Pat. Nos. 3,451,820, 4,080,211, and 4,367,282, and British Patent No.2,102,173.

Couplers releasing a photographically useful residue upon coupling are preferably used in the present invention. DIR couplers, i.e., couplers releasing a development inhibitor are described in the patents cited in the above-described Research Disclosure No. 17643, VII-F, JP-A-57-151944, JP-A-57-154234, JP-A-60-184248, and U.S. Pat. No. 4,248,962.

Preferable examples of a coupler imagewise releasing a nucleating agent or a development accelerator upon development are those described in British Patents Nos. 2,097,140, 2,131,188, JP-A-59-157638 and JP-A-59-170840.

Examples of a coupler which can be used in the light-sensitive material of the present invention are competing couplers described in, e.g., U.S. Pat. No. 4,130,427; poly-equivalent couplers described in U.S. Pat. Nos. 4,283,472, 4,338,393, and 4,310,618; DIR redox compound releasing couplers described in, e.g., JP-A-60-185950; and couplers releasing a dye which turns to a colored form after being released described in European Patent No. 173,302A.

The couplers for use in this invention can be used in the light-sensitive materials by various known dispersion methods.

Examples of a high-boiling solvent used in an oil-in-water dispersion method are described in U.S. Pat. No. 2,322,027 and the like.

Steps and effects of a latex dispersion method and examples of a loadable latex are described in U.S. Pat. No. 4,199,363, West German Patent Application (OLS) Nos. 2,541,274 and 2,541,230, and the like.

Examples of a support suitable for use in this invention are described in the above-described RD. No. 17643, page 28 and ibid., No. 18716, page 647, right column to page 648, left column.

The color photographic light-sensitive materials of this invention can be processed by the ordinary processes as described, for example, in above-described Research Disclosure, No. 17643, pages 28 to 29 and ibid., No. 18716, page 651, left column to right column.

After desilvering such as fixing or bleach-fixing the photographic light-sensitive material of the present invention is normally subjected to washing and/or stabilizing.

The amount of water used in the washing process can be arbitrarily determined over a broad range in accordance with the properties (e.g., a property determined by use of a coupler and the like) of the photographic light-sensitive material, the use of the material, the temperature of the water, the number of water tanks (the number of stages), the replenishing scheme representing a counter or forward current, and other conditions. The relationship between the amount of water and the number of water tanks in a multi-stage counter-current scheme can be obtained by a method described in "Journal of the Society of Motion Picture and Television Engineers, No. PP. 248-253 (May, 1955).

According to the above-described multi-stage counter-current scheme, the amount of water used for washing can be greatly decreased. However, since washing water stays in the tanks for a long period of time, bacteria growth and floating products may be undesirably attached to the light-sensitive material. In order to solve the above problem in the process of the color photographic light-sensitive material of the present invention, a method for decreasing calcium and magnesium ions can be effectively utilized, as described in JP-A-62-288838. In addition, an isothiazolone compound and cyabendazole, as described in JP-A-57-8542, a chlorine type germicide such as chlorinated sodium isocyanurate, described in JP-A-61-120145, benzotriazole described in Japanese Patent Application No. 60-105487, and germicides described in "Chemistry of Antibacterial and Antifungal Agents", Hiroshi Horiguchi, "Sterilization, Antibacterial, and Antifungal Techniques for Microorganisms" *Eiseigijutsu-Kai* ed., and "Dictionary of Bacteriacidal and Antifungal Agents", *Nippon Bokin Bokabi Gakkai* ed. can be used.

The pH of the water for washing the photographic light-sensitive material of the present invention is 4 to 9 and preferably 5 to 8. The water temperature and the washing time can vary according to the properties of the light-sensitive material and its application. Normally, the washing time falls within the range of 20 seconds to 10 minutes at a temperature of 15° to 45° C., and preferably 30 seconds to 5 minutes at a temperature of 25° to 40° C..

The light-sensitive material of the present invention can be processed directly by a stabilizer instead of washing with water. In this stabilizing process, any of methods described in JP-A-57-8543, JP-A-58-14834, JP-A-59-184343, JP-A-60-220345, JP-A-60-238832, JP-A-60-239784, JP-A-60-239749, JP-A-61-4054, and JP-A-61-118749 can be used. Especially, a stabilizing bath containing 1-hydroxyethylidene-1,1-diphosphonic acid, 5-chloro-2-methyl-4-isothiazoline-3-on, a bismuth compound, an ammonium compound, and the like is preferably used.

The stabilizing process is sometimes performed subsequently to the washing process. An example is a stabilizing bath containing formalin and a surfactant used as a final bath for a color light-sensitive material for photographing.

The present invention will be described below by way of Examples. However, the present invention is not limited to these Examples.

EXAMPLE 1

(1) PREPARATION OF EMULSIONS

While an aqueous solution obtained by dissolving 6 g of potassium bromide and 30 g of inactive gelatin to 3.7 liter of distilled water was agitated, a 14% aqueous potassium bromide solution and a 20% aqueous silver nitrate solution were added to the above aqueous solution by a double jet method at constant flow rates, over one minute, under the conditions of 55° C. and a pBr of 1.0 (in this addition (I), 2.40% of a total silver amount was consumed) Then, an aqueous gelatin solution (17%, 300 cc) was added to the resultant mixture, and the solution was agitated at 55° C.. Thereafter, sodium hydroxide was added to obtain a pH of 9.0. Then, chloroauric acid and sodium thiosulfate were added to the resultant mixture and left to stand for 20 minutes (grain internal chemical sensitization). Subsequently, the pH was set to be 5.5, and a 20% aqueous silver nitrate solution was added to the above solution at a constant flow rate until the pBr reached 1.40 (in this addition (II), 5.0% of the total silver amount was consumed) A 20% aqueous potassium bromide solution containing potassium iodide in order to add 8.3 g of potassium iodide and a 33% aqueous silver nitrate solution were added to the resultant mixture by the double jet method, over 80 minutes (in this addition (III), 92.6% of the total silver amount was consumed). During the addition, a temperature and the pBr were maintained at 55° C. and 1.50, respectively. A silver nitrate amount used in this emulsion was 425 g. Then, the resultant solution was desalted by a conventional flocculation method and optimally subjected to gold-plus-sulfur sensitization (grain surface chemical sensitization). In this preparation procedure, addition amounts of chloroauric acid and sodium thiosulfate were changed to prepare tabular AgBrI (AgI=2.0 mol%) emulsions A to C, 1 to 3, and D to F each having an average grain diameter/thickness ratio of 6.5, a sphere-equivalent diameter of 0.8 μm, and various surface sensitivity/internal sensitivity ratios. Each emulsion was a mono-dispersed hexagonal tabular emulsion whose variation coefficient of grain size distribution was 15% or less.

(2) PREPARATION OF COATED SAMPLES

Sensitizing dye S-5 was added to the emulsions obtained in (1). Then, dodecylbenzene sulfonate as a coating aid, p-vinyl benzene sulfonate as a thickening agent, a vinyl sulfonate series compound as a hardening agent, and a polyethylene oxide series compound as a photographic characteristics modifying agent were added to the resultant emulsions, thereby obtaining emulsion coating liquids. Subsequently, these liquids for coating were independently uniformly applied on an undercoated polyester base, and a surface protective layer mainly consisting of an aqueous gelatin solution was applied thereon. As a result, coated samples 1 to 9 respectively having emulsions A to C, 1 to 3, and D to F were prepared. In samples 1 to 9, a silver coating amount was 4.0 g/m$^2$, an amount of coated gelatin of protective layers was 1.3 g/m$^2$, and an amount of coated gelatin of emulsion layers was 2.7 g/m$^2$.

(3) EVALUATION OF COATED SAMPLES

Sample pieces of coated samples 1 to 9 prepared as described above were developed and subjected to sensitometry on the basis of the definition of the surface sensitivity/internal sensitivity ratio in this specification, thereby obtaining the surface sensitivity/internal sensitivity ratio.

Sample pieces of coated samples 1 to 9 subjected to wedge exposure with an exposure amount of 50 CMS for an exposure time of 1/100 second were simultaneously developed by a developer-I consisting of the following composition at 20° C. for 4'. Then, after fixing, washing, and drying, sensitometry was performed. Thereafter, photographic sensitivity was obtained in accordance with a reciprocal of an exposure amount which gives a density of fog+0.1.

| Developer-I: | |
|---|---|
| 1-phenyl-3-pyrazolidone | 0.5 g |
| Hydroquinone | 10 g |
| Disodium Ethylenediaminetetraacetate | 2 g |
| Potassium Sulfite | 60 g |
| Boric Acid | 4 g |
| Potassium Carbonate | 20 g |
| Potassium Thiocyanate | 1.2 g |
| Sodium Bromide | 5 g |
| Diethylene Glycol | 20 g |
| Sodium Hydroxide to obtain a pH of | 10.0 |
| Water to make | 1 liter |

The resistance to stress was evaluated by bending each sample piece of coated samples 1 to 9 at 25° C. and relative humidity of 40%. The sample pieces were bent through 180° along an iron rod having a diameter of 6 mm. The sample pieces were wedge-exposed for $10^2$ second immediately after this bending. The exposed sample pieces were developed in developer-I having a temperature of 20° C. for four minutes. Then, the developed sample pieces were fixed and washed with water.

Then, the resistance to stress was evaluated by ΔFog/Dm where ΔFog is the change in the fog density caused by bending, and Dm in the maximum density.

The results are summarized in Table 1 below.

TABLE 1

| Sample No. | Emulsion | Surface Sensitivity / Internal Sensitivity | Sensitivity Obtained by Developer-I* | Degree of Stress Marks (ΔFog/Dm) | |
|---|---|---|---|---|---|
| 1 | Emulsion A | >1000 | 100 | 0.060 | Comparative Example |
| 2 | Emulsion B | 100 | 100 | 0.060 | Comparative Example |
| 3 | Emulsion C | 4.2 | 99 | 0.058 | Comparative Example |
| 4 | Emulsion 1 | 1.9 | 99 | 0.020 | Present Invention |
| 5 | Emulsion 2 | 1.0 | 99 | 0.008 | Present Invention |
| 6 | Emulsion 3 | 0.55 | 97 | 0.005 | Present Invention |
| 7 | Emulsion D | 0.25 | 50 | 0.004 | Comparative Example |
| 8 | Emulsion E | 0.09 | 2 | 0.003 | Comparative Example |
| 9 | Emulsion F | 0.008 | 0.05 | 0.001 | Comparative Example |

*Sensitivity obtained by developer-I is represented assuming that sensitivity of sample 1 is 100.

As is apparent from Table 1, the resistance to stress of coated samples 4 to 6 having emulsions 1 to 3 of the present invention in which the surface sensitivity/internal sensitivity ratio falls within the range of 0.5 to 2.0 is improved without largely degrading the photographic sensitivity. That is, an effect of the present invention is significant.

EXAMPLE 2

(1) PREPARATION OF EMULSIONS

An aqueous solution was obtained by dissolving 6 g of potassium bromide and 30 g of inactive gelatin in 2 liter of distilled water. Then, a 14% aqueous potassium bromide solution containing 1.1 g of potassium iodide and a 20% aqueous silver nitrate solution were added to the above aqueous solution by the double jet method at constant flow rates over 2 minutes under the conditions of 55° C. and a pBr of 1.0 (in this addition (I'), 5.0% of the total silver amount was consumed). An aqueous gelatin solution (17%, 300 cc) was added. Then, a solution containing 2.1 g of potassium iodide and a 20% aqueous silver nitrate solution were added at constant flow rates until the pBr reached a value of 1.3 (in this addition (II'), 10.0% of the total silver amount was consumed). A 20% aqueous potassium bromide solution containing potassium iodide in an amount for adding a gram of potassium iodide and a 33% aqueous silver nitrate solution were added by the double jet method, thereby preparing core grains (in this addition (III'), 30.0% of the total silver amount was consumed). During the addition, a temperature and a pBr were maintained at 55° C. and a value of 1.3, respectively. Then, a 20% aqueous potassium bromide solution containing b gram of potassium iodide and a 33% of aqueous silver nitrate solution were added by the double jet method over five minutes, thereby forming an intermediate phase. (In this addition (IV'), 5.0% of the total silver amount was consumed). During the addition, a temperature and pBr were maintained at 55° C. and a value of 1.3, respectively. Then, a 20% aqueous potassium bromide solution containing potassium iodide in an amount for adding c gram of potassium iodide and a 33% aqueous silver nitrate solution were added by the double jet method to form shell on the grain (in this addition (V'), 50% of the total silver amount was consumed). During the addition, a temperature and a pBr were maintained at 55° C. and a value of 1.3. A silver nitrate amount used in this emulsion was 425 g. Then, desalting was performed by a conventional flocculation method, and gold-plus-sulfur sensitization was optimally performed. In this preparation procedure, amounts a to c of the potassium iodide were changed to prepare tabular AgBrI (AgI=5 mol%) emulsions G to I and 4 to 6 each having an average sphere-equivalent diameter of 0.5 μm, an average grain diameter/thickness ratio of 12±2, and a grain internal iodide structure as shown in Table 2.

TABLE 2

| Emulsion No. | Iodide Content (mol %) of Core Phase | Iodide Content (mol %) of Intermediate Phase | Iodide Content (mol %) of Shell Phase |
|---|---|---|---|
| Emulsion G | 5.0 | 5.0 | 5.0 |
| Emulsion H | 4.9 | 7.0 | 4.9 |
| Emulsion I | 4.7 | 10.0 | 4.7 |
| Emulsion 4 | 4.5 | 13.0 | 4.5 |
| Emulsion 5 | 4.5 | 15.0 | 4.5 |

TABLE 2-continued

| Emulsion No. | Iodide Content (mol %) of Core Phase | Iodide Content (mol %) of Intermediate Phase | Iodide Content (mol %) of Shell Phase |
|---|---|---|---|
| Emulsion 6 | 4.4 | 17.0 | 4.4 |

(2) PREPARATION AND EVALUATION OF COATED SAMPLES

Following the same procedures as in (2) of EXAMPLE 1, coated samples 10 to 15 having emulsions G to I and 4 to 6 were prepared.

Then, following the same procedures as in the method described in (3) of EXAMPLE 1, the surface sensitivity/internal sensitivity ratio, the sensitivity obtained by developer-I, and the resistance to stress were evaluated.

The results are summarized in Table 3.

TABLE 3

| Sample No. | Emulsion | Surface Sensitivity / Internal Sensitivity | Sensitivity Obtained by Developer-I* | Degree of Stress Marks (ΔFog/Dm) | |
|---|---|---|---|---|---|
| 10 | Emulsion G | >1000 | 100 | 0.052 | Comparative Example |
| 11 | Emulsion H | 800 | 100 | 0.053 | Comparative Example |
| 12 | Emulsion I | 10 | 100 | 0.050 | Comparative Example |
| 13 | Emulsion 4 | 2.0 | 100 | 0.025 | Present Invention |
| 14 | Emulsion 5 | 1.5 | 98 | 0.009 | Present Invention |
| 15 | Emulsion 6 | 0.9 | 97 | 0.005 | Present Invention |

Sensitivity obtained by developer-I is represented assuming that sensitivity of sample 1 is 100.

As is apparent from Table 3, the resistance to stress of coated samples 13 to 15 having emulsions to 6 of the present invention in which the surface sensitivity/internal sensitivity ratio falls within the range of 0.5 to 2.0 was improved without largely degrading the photographic sensitivity. That is, an effect of the present invention is significant as in EXAMPLE 1.

EXAMPLE 3

A multilayer color light-sensitive material comprising a plurality of layers having the following compositions was formed on an undercoated triacetylcellulose film support to prepare samples 101 to 103 containing emulsions A, 2, and F described in Example 1 in their third green-sensitive layers and second and third blue-sensitive layers.

| | |
|---|---|
| Layer 1: Antihalation Layer: | |
| Black Colloid Silver | 0.25 g/m$^2$ |
| Ultraviolet Absorbent U-1 | 0.1 g/m$^2$ |
| Ultraviolet Absorbent U-2 | 0.1 g/m$^2$ |
| High Boiling Organic Solvent Oil-1 | 0.1 cc/m$^2$ |
| Gelatin | 1.9 g/m$^2$ |
| Layer 2: Interlayer-1: | |
| Compound Cpd D | 10 mg/m$^2$ |
| High Boiling Organic Solvent Oil-3 | 40 mg/m$^2$ |
| Gelatin | 0.4 g/m$^2$ |
| Layer 3: Interlayer-2: | |
| Surface-fogged Fine Silver Iodobromide Emulsion (mean grain size: 0.06μ, AgI | |

-continued content: 1 mol %)

| | | |
|---|---|---|
| | silver | 0.05 g/m² |
| Gelatin | | 0.4 g/m² |

Layer 4: 1st Red-sensitive Emulsion Layer:

Silver Iodobromide Emulsion (a 1:1 mixture of a mono-dispersed cubic emulsion having a mean grain size of 0.2μ and an AgI content of 5 mol % and a mono-dispersed cubic emulsion having a mean grain size of 0.1μ and an AgI content of 5 mol %) Spectrally Sensitized with Sensitizing Dyes S-1 and S-2

| | | |
|---|---|---|
| | silver | 0.4 g/m² |
| Coupler C-1 | | 0.2 g/m² |
| Coupler C-2 | | 0.05 g/m² |
| High Boiling Organic Solvent Oil-1 | | 0.1 cc/m² |
| Gelatin | | 0.8 g/m² |

Layer 5: 2nd Red-sensitive Emulsion Layer:

Silver Iodobromide Emulsion (a mono-dispersed cubic emulsion having a mean grain size of 0.3μ and an AgI content of 4 mol %) Spectrally Sensitized with Sensitizing Dyes S-1 and S-2

| | | |
|---|---|---|
| | silver | 0.4 g/m² |
| Coupler C-1 | | 0.2 g/m² |
| Coupler C-3 | | 0.2 g/m² |
| Coupler C-2 | | 0.05 g/m² |
| High Boiling Organic Solvent Oil-1 | | 0.1 cc/m² |
| Gelatin | | 0.8 g/m² |

Layer 6: 3rd Red-sensitive Emulsion Layer:

Silver Iodobromide Emulsion (a mono-dispersed cubic emulsion having a mean grain size of 0.4μ and an AgI content of 2 mol %) Spectrally Sensitized with Sensitizing Dyes S-1 and S-2

| | | |
|---|---|---|
| | silver | 0.4 g/m² |
| Coupler C-3 | | 0.7 g/m² |
| Gelatin | | 1.1 g/m² |

Layer 7: Interlayer-3:

| | | |
|---|---|---|
| Dye D-1 | | 0.02 g/m² |
| Gelatin | | 0.6 g/m² |

Layer 8: Interlayer-4:

Surface-fogged Fine Silver Iodobromide (mean grain size: 0.06μ, AgI content: 1 mol %)

| | | |
|---|---|---|
| | silver | 0.05 g/m² |
| Compound Cpd A | | 0.2 g/m² |
| Gelatin | | 1.0 g/m² |

Layer 9: 1st Green-sensitive Emulsion Layer:

Silver Iodobromide Emulsion (a 1:1 mixture of a mono-dispersed cubic emulsion having a mean grain size of 0.2μ and an AgI content of 5 mol % and a mono-dispersed cubic emulsion having a mean grain size of 0.1μ and an AgI content of 5 mol %) Spectrally Sensitized with Sensitizing Dyes S-3 and S-4

| | | |
|---|---|---|
| | silver | 0.5 g/m² |
| Coupler C-4 | | 0.3 g/m² |
| Compound Cpd B | | 0.03 g/m² |
| Gelatin | | 0.5 g/m² |

Layer 10: 2nd Green-sensitive Emulsion Layer:

Silver Iodobromide Emulsion (a mono-dispersed cubic emulsion having a mean grain size of 0.4μ and an AgI content of 5 mol %) Spectrally Sensitized with Sensitizing Dyes S-3 and S-4

| | | |
|---|---|---|
| | silver | 0.4 g/m² |
| Coupler C-4 | | 0.3 g/m² |
| Compound Cpd B | | 0.03 g/m² |
| Gelatin | | 0.6 g/m² |

Layer 11: 3rd Green-sensitive Emulsion Layer:

Silver Iodobromide Emulsion (emulsion A, 2, or F described in Example 1) Spectrally Sensitized with Sensitizing Dyes S-3 and S-4

| | | |
|---|---|---|
| | silver | 0.5 g/m² |
| Coupler C-4 | | 0.8 g/m² |
| Compound Cpd B | | 0.08 g/m² |
| Gelatin | | 1.0 g/m² |

Layer 12: Interlayer-5:

| | | |
|---|---|---|
| Dye D-2 | | 0.05 g/m² |
| Gelatin | | 0.6 g/m² |

Layer 13: Yellow Filter Layer:

| | | |
|---|---|---|
| Yellow Colloid Silver | | 0.1 g/m² |
| Compound Cpd A | | 0.01 g/m² |
| Gelatin | | 1.1 g/m² |

Layer 14: 1st Blue-sensitive Emulsion Layer:

Silver Iodobromide Emulsion (a 1:1 mixture of a mono-dispersed cubic emulsion having a mean grain size of 0.2μ and an AgI content of 3 mol % and a mono-dispersed cubic emulsion having a mean grain size of 0.1μ and an AgI content 3 mol %) Spectrally Sensitized with Sensitizing Dyes S-5 and S-6

| | | |
|---|---|---|
| | silver | 0.6 g/m² |
| Coupler C-5 | | 0.6 g/m² |
| Gelatin | | 0.8 g/m² |

Layer 15: 2nd Blue-sensitive Emulsion Layer:

Silver Iodobromide Emulsion (the same emulsion as the emulsion of the 3rd green-sensitive emulsion layer) Spectrally Sensitized with Sensitizing Dyes S-5 and S-6

| | | |
|---|---|---|
| | silver | 0.4 g/m² |
| Coupler C-5 | | 0.3 g/m² |
| Coupler C-6 | | 0.3 g/m² |
| Gelatin | | 0.9 g/m² |

Layer 16: 3rd Blue-sensitive Emulsion Layer:

Silver Iodobromide Emulsion (the same emulsion as the emulsion of the 3rd green-sensitive emulsion layer) Spectrally Sensitized with Sensitizing Dyes S-5 and S-6

| | | |
|---|---|---|
| | silver | 0.4 g/m² |
| Coupler C-6 | | 0.7 g/m² |
| Gelatin | | 1.2 g/m² |

Layer 17: 1st Protective Layer:

| | | |
|---|---|---|
| Ultraviolet Absorvent U-1 | | 0.04 g/m² |
| Ultraviolet Absorvent U-3 | | 0.03 g/m² |
| Ultraviolet Absorvent U-4 | | 0.03 g/m² |
| Ultraviolet Absorvent U-5 | | 0.05 g/m² |
| Ultraviolet Absorvent U-6 | | 0.05 g/m² |
| Compound Cpd C | | 0.8 g/m² |
| Dye D-3 | | 0.05 g/m² |
| Gelatin | | 0.7 g/m² |

Layer 18: 2nd Protective Layer:

Surface-fogged Fine Silver Iodobromide Emulsion (mean grain size: 0.06μ, AgI content: 1 mol %)

| | | |
|---|---|---|
| | silver | 0.1 g/m² |
| Polymethyl Methacrylate Grains (mean grain size: 1.5μ) | | 0.1 g/m² |
| 4:6 Copolymer of Methyl Methacrylate and Acrylic Acid (mean grain size: 1.5μ) | | 0.1 g/m² |
| Silicone Oil | | 0.03 g/m² |
| Fluorine-containing Surface Active Agent W-1 | | 3 mg/m² |
| Gelatin | | 0.8 g/m² |

Gelatin hardening agent H-1 and a surface active agent were added to the layers in addition to the above compositions.

Some pieces of samples 101 to 103 prepared as described above were stressed by the method described in (3) of EXAMPLE 1, wedge-exposed together with the other pieces of each sample, which were not stressed, for an exposure time of 1/100 second with an exposure amount of 50 CMS, and all the pieces were then developed as follows.

Process Steps of Development:

| Step | Time | Temperature |
|---|---|---|
| 1st Development | 6 min. | 38° C. |
| Washing | 2 min. | 38° C. |
| Reversal Development | 3 min. | 38° C. |
| Color Development | 6 min. | 38° C. |
| Conditioning | 2 min. | 38° C. |
| Bleaching | 6 min. | 38° C. |
| Fixing | 4 min. | 38° C. |
| Washing | 4 min. | 38° C. |
| Stabilizing | 1 min. | Room Temperature |

-continued

| Process Steps of Development: | | |
|---|---|---|
| Step | Time | Temperature |
| Drying | | |

The compositions of processing solutions were as follows.

| | |
|---|---|
| First Developer: | |
| Water | 700 ml |
| Pentasodium Nitrilo-N,N,N-trimethylenephosphonate | 2 g |
| Sodium Sulfite | 20 g |
| Hydroquinone Monosulfonate | 30 g |
| Sodium Carbonate (Monohydrate) | 30 g |
| 1-phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% solution) | 2 ml |
| Water to make | 1,000 ml |
| Reversing Solution: | |
| Water | 700 ml |
| Pentasodium Nitrilo-N,N,N-trimethylenephosphonate | 3 g |
| Stannous Chloride (Dihydrate) | 1 g |
| p-aminophenol | 0.1 g |
| Sodium Hydroxide | 8 g |
| Glacial Acetic Acid | 15 ml |
| Water to make | 1,000 ml |
| Color Developer: | |
| Water | 700 ml |
| Pentasodium Nitrilo-N,N,N-trimethylenephosphonate | 3 g |
| Sodium Sulfite | 7 g |
| Sodium Tetrary Phosphate (Dodecahydrate) | 36 g |
| Potassium Bromide | 1 g |
| Potassium Iodide (0.1% solution) | 90 ml |
| Sodium Hydroxide | 3 g |
| Citrazinic Acid | 1.5 g |
| N-ethyl-N-(β-methanesulfonamidoethyl)-3-methyl-4-aminoaniline Sulfate | 11 g |
| 3,6-dithiaoctane-1,8-diol | 1 g |
| Water to make | 1,000 ml |
| Conditioning Solution: | |
| Water | 700 ml |
| Sodium Sulfite | 12 g |
| Sodium Ethylenediaminetetraacetate (Dihydrate) | 8 g |
| Thioglycerin | 0.4 ml |
| Glacial Acetic Acid | 3 ml |
| Water to make | 1,000 ml |
| Bleaching Solution: | |
| Water | 800 ml |
| Sodium ethylenediaminetetraacetate (Dihydrate) | 2 g |
| Ammonium Iron (III) Ethylenediaminetetraacetate (Dihydrate) | 120 g |
| Potassium Bromide | 100 g |
| Water to make | 1,000 ml |
| Fixing Solution: | |
| Water | 800 ml |
| Ammonium Thiosulfate | 80.0 g |
| Sodium Sulfite | 5.0 g |
| Sodium Bisulfite | 5.0 g |
| Water to make | 1,000 ml |
| Stabilization Solution: | |
| Water | 800 ml |
| Formalin (37 wt %) | 5.0 ml |
| Fuji Drywell (surface active agent available from Fuji Photo Film Co., Ltd.) | 5.0 ml |

-continued

| | |
|---|---|
| Water to make | 1,000 ml |

Color reversal sensitivities of the 3rd greensensitive layer and the 2nd and 3rd blue-sensitive layers were estimated on the basis of a relative exposure amount for giving density larger by 2.0 than a minimum density of magenta and yellow densities.

As a result, sensitivity of sample 102 was substantially the same as that of sample 101, but sensitivity of sample 103 was as low as 1/10 that of sample 101. As for resistance to stress, as compared with sample 101, reductions in the yellow and magenta densities from non-stressed portions to stressed portions at the high density side of samples 103 and 104 of this invention are largely reduced.

EXAMPLE 4

Layers consisting of the following compositions were applied on an undercoated triacetylcellulose support, thereby preparing multilayer color light-sensitive material samples 201 and 202 containing emulsion G or 5 described in Example 2 in their 2nd green-sensitive layers and 2nd blue-sensitive layers.

| | | | |
|---|---|---|---|
| Layer 1: Antihalation Layer: | | | |
| Black Colloid Silver | silver | 0.18 | g/m$^2$ |
| Gelatin | | 1.40 | g/m$^2$ |
| Layer 2: Interlayer: | | | |
| 2,5-di-t-Pentadecyl Hydroquinone | | 0.18 | g/m$^2$ |
| C-11 | | 0.07 | g/m$^2$ |
| C-13 | | 0.02 | g/m$^2$ |
| U-11 | | 0.08 | g/m$^2$ |
| U-12 | | 0.08 | g/m$^2$ |
| Oil-2 | | 0.10 | g/m$^2$ |
| Oil-1 | | 0.02 | g/m$^2$ |
| Gelatin | | 1.0 | g/m$^2$ |
| Layer 3: 1st Red-sensitive Emulsion Layer: | | | |
| Silver Iodobromide Emulsion (irregular multi-twinning grains having an iodide content of 5 mol % and a mean grain sphere-equivalent size of 0.3 μ) Spectrally Sensitized with Sensitizing Dyes S-11, S-12, S-13, and S-18 | silver | 0.50 | g/m$^2$ |
| C-12 | | 0.14 | g/m$^2$ |
| Oil-2 | | 0.005 | g/m$^2$ |
| C-20 | | 0.005 | g/m$^2$ |
| Gelatin | | 1.20 | g/m$^2$ |
| Layer 4: 2nd Red-sensitive Emulsion Layer: | | | |
| Silver Iodobromide Emulsion (irregular multi-twinning grains having an iodide content of 5 mol % and a mean grain sphere-equivalent size of 0.6 μ) Spectrally Sensitized with Sensitizing Dyes S-11, S-12, S-13, and S-18 | silver | 1.15 | g/m$^2$ |
| C-12 | | 0.060 | g/m$^2$ |
| C-13 | | 0.008 | g/m$^2$ |
| C-20 | | 0.004 | g/m$^2$ |
| Oil-2 | | 0.005 | g/m$^2$ |
| Gelatin | | 1.50 | g/m$^2$ |
| Layer 5: 3rd Red-sensitive Emulsion Layer: | | | |
| Silver Iodobromide Emulsion (irregular multi-twinning grains having an iodide content of 5 mol % and a mean grain sphere-equivalent size of 0.8 μ) Spectrally Sensitized with Sensitizing Dyes S-11, S-12, S-13, and S-18 | silver | 1.50 | g/m$^2$ |
| C-15 | | 0.012 | g/m$^2$ |
| C-13 | | 0.003 | g/m$^2$ |
| C-14 | | 0.004 | g/m$^2$ |
| Oil-2 | | 0.32 | g/m$^2$ |
| Gelatin | | 1.63 | g/m$^2$ |
| Layer 6: Interlayer: | | | |

-continued

| | | |
|---|---|---|
| Gelatin | 1.06 | g/m² |
| Layer 7: 1st Green-sensitive Emulsion Layer: | | |
| Silver Iodobromide Emulsion (irregular multi-twinning grains having an iodide content of 5 mol % and a mean grain sphere-equivalent size of 0.3 μ) Spectrally Sensitized with Sensitizing Dyes S-14, S-15, and S-16 | silver 0.35 | g/m² |
| C-16 | 0.120 | g/m² |
| C-11 | 0.021 | g/m² |
| C-17 | 0.030 | g/m² |
| C-18 | 0.025 | g/m² |
| Oil-2 | 0.20 | g/m² |
| Gelatin | 0.70 | g/m² |
| Layer 8: 2nd Green-sensitive Emulsion Layer: | | |
| Silver Iodobromide Emulsion (emulsion G to 5 described in Example 2) Spectrally Sensitized with Sensitizing Dyes S-14, S-15, and S-16 | silver 0.75 | g/m² |
| C-16 | 0.021 | g/m² |
| C-18 | 0.004 | g/m² |
| C-11 | 0.002 | g/m² |
| C-17 | 0.003 | g/m² |
| Oil-2 | 0.15 | g/m² |
| Gelatin | 0.80 | g/m² |
| Layer 9: 3rd Green-sensitive Emulsion Layer: | | |
| Silver Iodobromide Emulsion (irregular multi-twinning grains having an iodide content of 5 mol % and a mean grain sphere-equivalent size of 0.8 μ) Spectrally Sensitized with Sensitizing Dyes S-14, S-15, and S-16 | silver 1.80 | g/m² |
| C-16 | 0.011 | g/m² |
| C-11 | 0.001 | g/m² |
| Oil-1 | 0.69 | g/m² |
| Gelatin | 1.74 | g/m² |
| Layer 10: Yellow Filter Layer: | | |
| Yellow Colloid Silver | silver 0.05 | g/m² |
| 2,5-di-t-pentadecyl Hydroquinone | 0.03 | g/m² |
| Gelatin | 0.95 | g/m² |
| Layer 11: 1st Blue-sensitive Emulsion Layer: | | |
| Silver Iodobromide Emulsion (irregular multi-twinning grains having an iodide content of 5 mol % and a mean grain sphere-equivalent size of 0.3 μ) Sepectrally Sensitized with Sensitizing Dye S-17 | silver 0.24 | g/m² |
| C-19 | 0.27 | g/m² |
| C-18 | 0.005 | g/m² |
| Oil-2 | 0.28 | g/m² |
| Gelatin | 1.28 | g/m² |
| Layer 12: 2nd Blue-sensitive Emulsion Layer: | | |
| Silver Iodobromide Emulsion (the same emulsion as the emulsion of the 2nd green-sensitive layer) Spectrally Sensitized with Sensitizing Dye S-17 | silver 0.45 | g/m² |
| C-19 | 0.098 | g/m² |
| Oil-2 | 0.03 | g/m² |
| Gelatin | 0.46 | g/m² |
| Layer 13: 3rd Blue-sensitive Emulsion Layer: | | |
| Silver Iodobromide Emulsion (irregular multi-twinning grains having an iodide content of 5 mol % and a mean grain sphere-equivalent size of 0.8 μ) Spectrally Sensitized with Sensitizing Dye S-17 | silver 0.77 | g/m² |
| U-11 | 0.036 | g/m² |
| Oil-2 | 0.07 | g/m² |
| Gelatin | 0.69 | g/m² |
| Layer 14: 1st Protective Layer: | | |
| Silver Iodobromide (silver iodide: 1 mol %, mean grain size: 0.07 μ) | silver 0.5 | g/m² |
| U-11 | 0.11 | g/m² |
| U-12 | 0.17 | g/m² |
| Oil-2 | 0.90 | g/m² |
| Layer 15: 2nd Protective Layer: | | |
| Polymethylmethacrylate | 0.54 | g/m² |

-continued

| | | |
|---|---|---|
| Grains (size: about 1.5 μm) | | |
| U-13 | 0.15 | g/m² |
| U-14 | 0.10 | g/m² |
| Gelatin | 0.72 | g/m² |

Gelatin hardening agent H-1 and a surface active agent were added to the layers in addition to the above compositions.

Some of pieces of samples No. 201 and 202 prepared as described above were stressed by the method described in (3) of Example 1, wedge-exposed together with the other pieces of either sample which were not stressed, for 1/100 second with 100 CMS, and all the pieces were then developed as follows:

| Step of Development (38° C.) | Time |
|---|---|
| Color Development | 3 min. 15 sec. |
| Bleaching | 6 min. 30 sec. |
| Washing | 2 min. 10 sec. |
| Fixing | 4 min. 20 sec. |
| Washing | 3 min. 15 sec. |
| Stabilizing | 1 min. 05 sec. |

The compositions of processing solutions used in the above steps were as follows.

| | |
|---|---|
| Color Developer: | |
| Diethylenetriaminepentaacetic Acid | 1.0 g |
| 1-hydroxyethylidene-1,1-Diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxyamine Sulfate | 2.4 g |
| 4-(N-ethyl-N--hydroxyethylamino)-2-methylaniline Sulfate | 4.5 g |
| Water to make | 1.0 liter |
| pH | 10.0 |
| Bleaching Solution: | |
| Ferric Ammonium Ethylenediaminetetraacetate | 100.0 g |
| Disodium Ethylenediaminetetraacetate | 10.0 g |
| Ammonium Bromide | 150.0 g |
| Ammonium Nitrate | 10.0 g |
| Water to make | 1.0 liter |
| pH | 6.0 |
| Fixing Solution: | |
| Disodium Ethylenediaminetetraacetate | 1.0 g |
| Sodium Sulfite | 4.0 g |
| Aqueous Ammonium Thiosulfate Solution (70%) | 175.0 ml |
| Sodium Bisulfite | 4.6 g |
| Water to make | 1.0 liter |
| pH | 6.6 |
| Stabilizing Solution: | |
| Formalin (40%) | 2.0 ml |
| Polyoxyethylene-p-mononononylphenylether (mean polymerization degree: 10) | 0.3 g |
| Water to make | 1.0 liter |

Color negative sensitivities of the 2nd green-sensitive layer and the 2blue-sensitive layer were estimated on the basis of a relative exposure amount for giving density larger by 0.1 than a minimum density of magenta and yellow densities. As a result, as in Example 2, sensitivity of sample 202 was substantially the same as that of sample 201. However, almost no change in fog (increases in magenta and yellow densities) was found at the stressed portion in sample 202 which contained emulsion 5 of the present invention while it was significant in sample 201 which contained comparative emulsion G.
Structures of the compounds used in Examples 1 to 4 are shown in Table 4.
TABLE 4
C-1
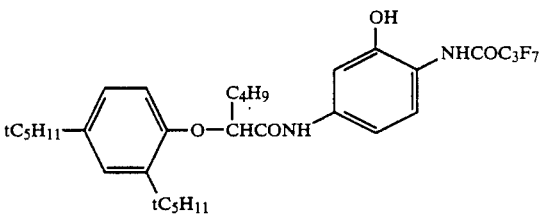
C-2
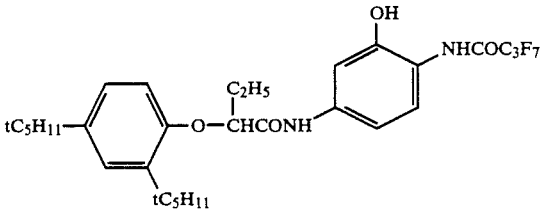
C-3
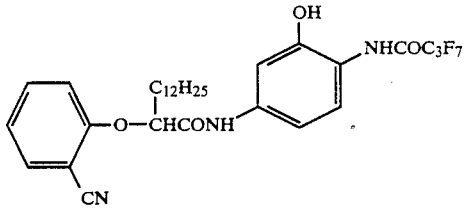
C-4
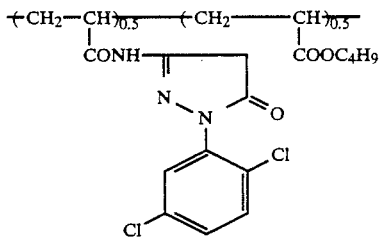
C-5
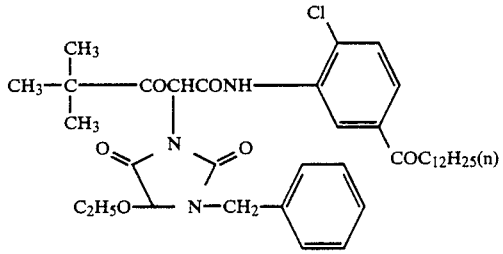
C-6
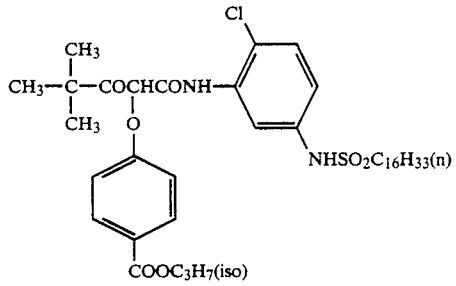

-continued
TABLE 4
C-11
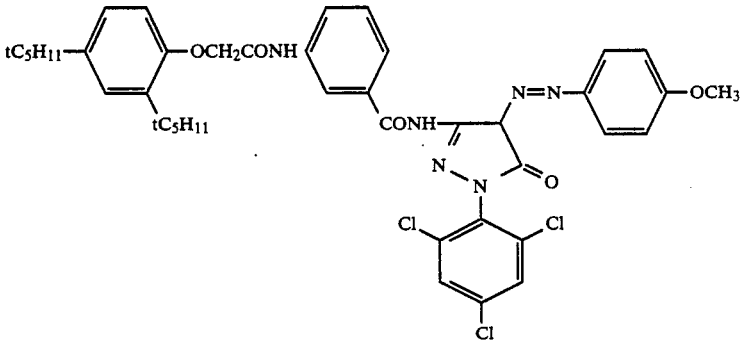
C-12
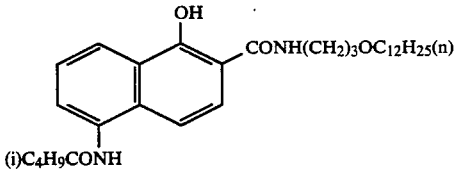
C-13
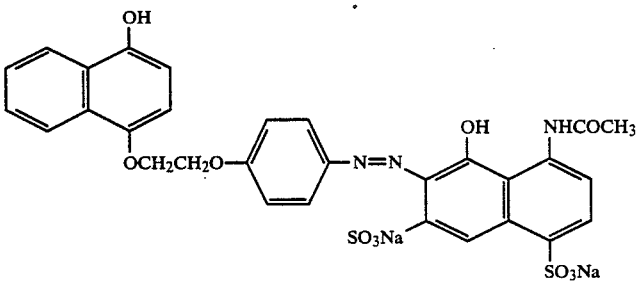
C-14
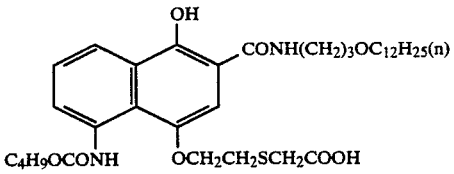
C-15
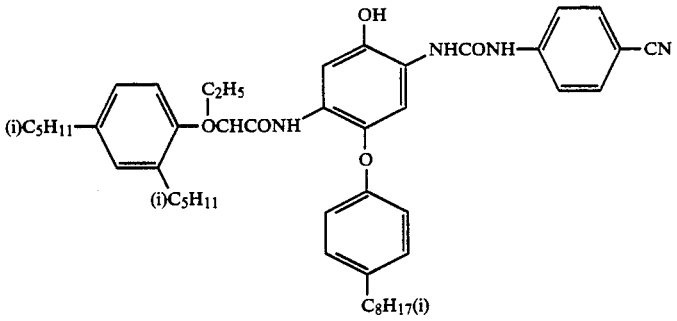

-continued
TABLE 4
C-16
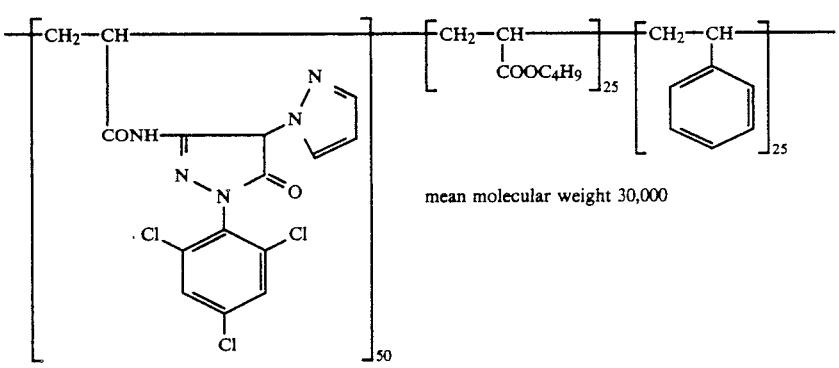
mean molecular weight 30,000
C-17
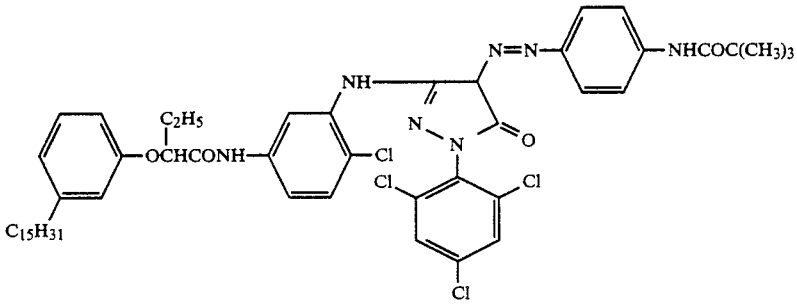
C-18
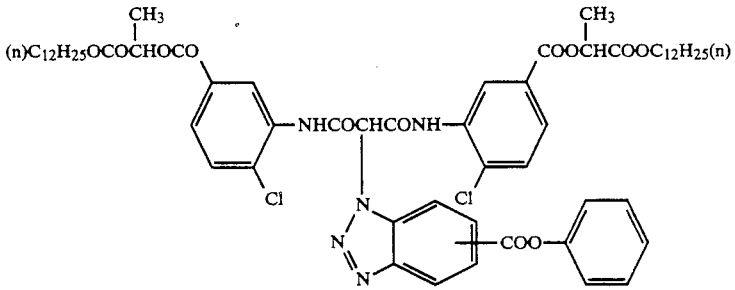
C-19
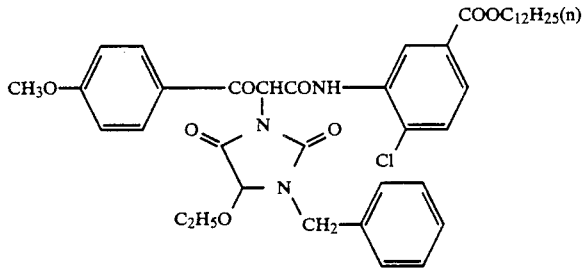
C-20
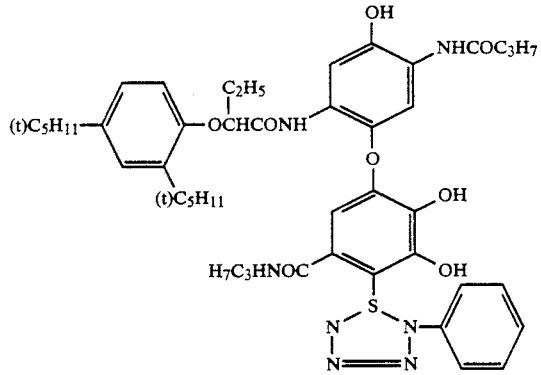

-continued
TABLE 4
S-1
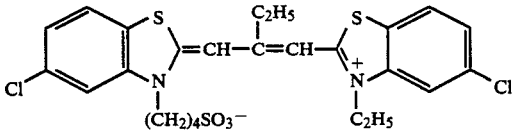
S-2
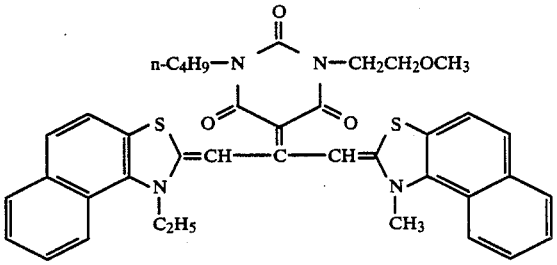
S-3
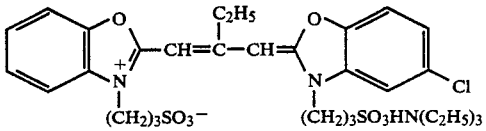
S-4
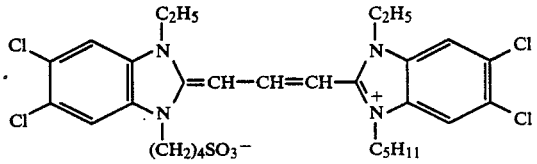
S-5
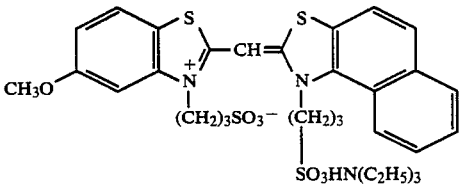
S-6
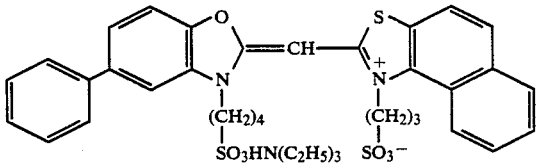
S-11
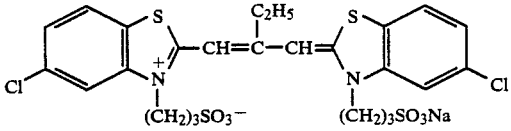
S-12
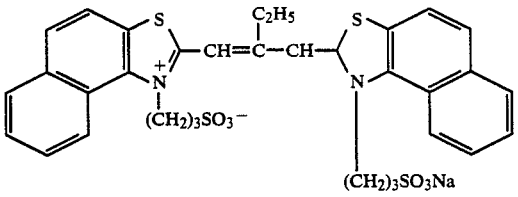

-continued
TABLE 4
S-13
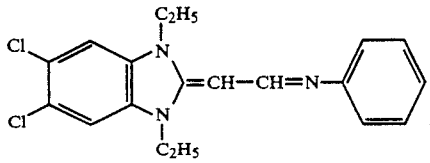
S-14
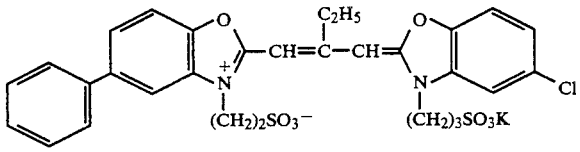
S-15
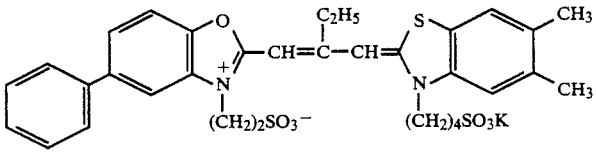
S-16
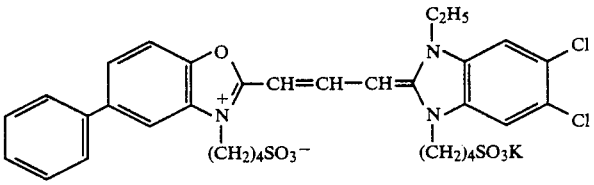
S-17
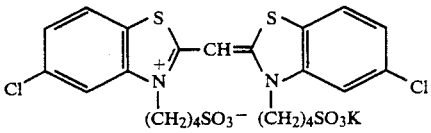
S-18
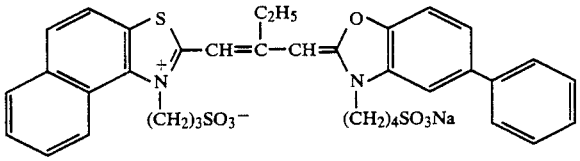
U-1
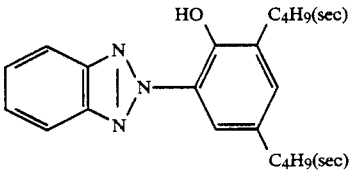
U-2
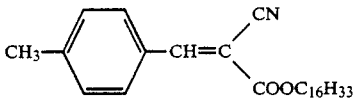
U-3
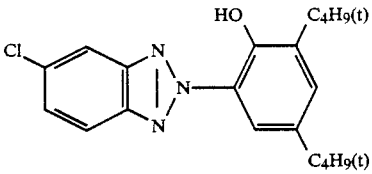

-continued
TABLE 4
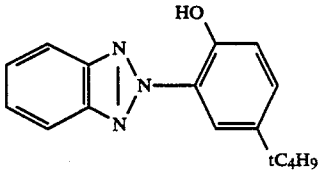
U-4
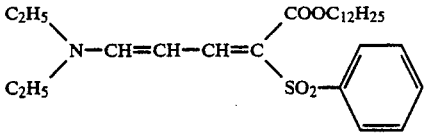
U-5
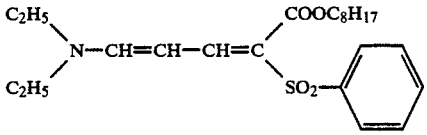
U-6
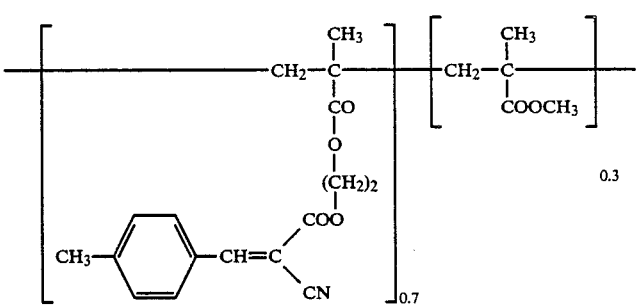
U-11
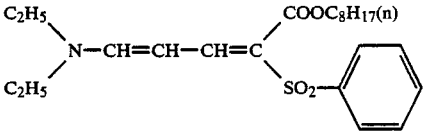
U-12
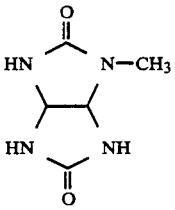
U-13
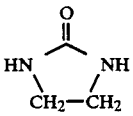
U-14
dibutyl phthalate — Oil 1
tricresyl phosphate — Oil 2
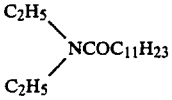
Oil 3
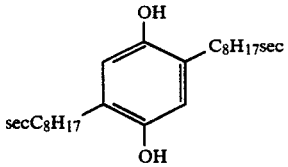
Cpd A -continued

TABLE 4

Cpd B

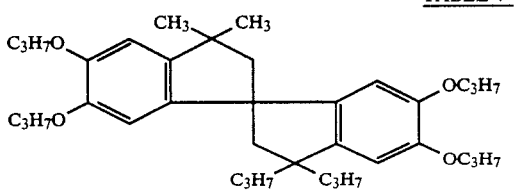

Cpd C

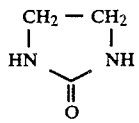

Cpd D

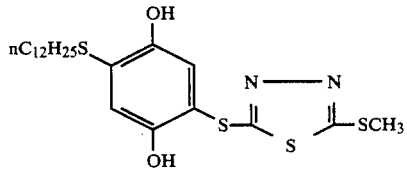

D-1

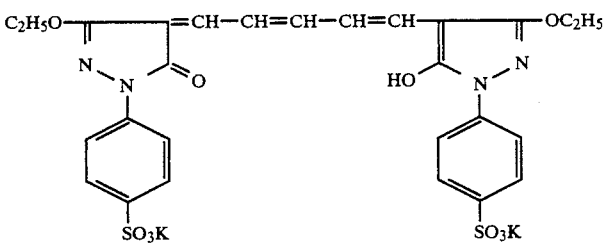

D-2

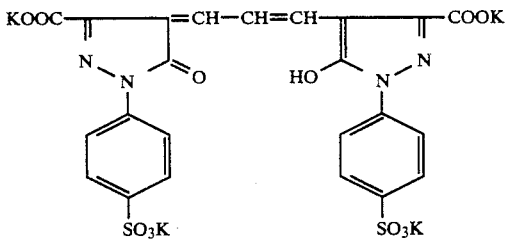

D-3

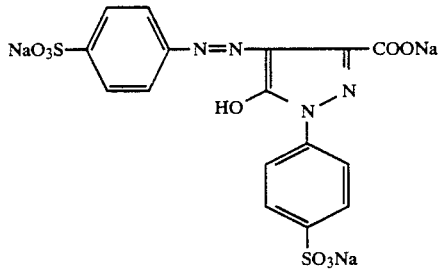

H-1

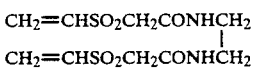

W-1

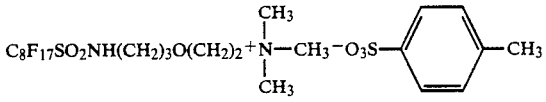

What is claimed is:

1. A silver halide photographic light-sensitive material comprising a support having thereon at least one silver halide light-sensitive emulsion layer, wherein at least one of a plurality of emulsions contained in said emulsion layer contains tabular grains having a thickness of less than 0.5 μm, a diameter of at least 0.3 μm, and an average ratio of grain diameter to grain thickness of at least 2, said tubular grains occupy at least 50% of the entire projected area of all grains contained in said emulsion, the surfaces of said grains are chemically sensitized, and the ratio of surface sensitivity to internal sensitivity of said grains is 0.5 to 2.

2. The silver halide photographic light-sensitive material as in claim 1, wherein said tubular grains have a thickness of at least 0.05 μm, but less than 0.5 μm.

3. The silver halide photographic light-sensitive material as in claim 1, wherein said tabular grains have a thickness of 0.08 μm to 0.3 μm.

4. The silver halide photographic light-sensitive material as in claim 1, wherein said tabular grains have a diameter of 0.3 μm to 10 μm.

5. The silver halide photographic light-sensitive material as in claim 1, wherein said tabular grains have a diameter of 0.5 μm to 2.0 μm.

6. The silver halide photographic light-sensitive material as in claim 1, wherein said tabular grains have an average ratio of grains diameter to grain thickness of 3 to 12.

7. The silver halide photographic light-sensitive material as in claim 1, wherein said tabular grains have an average ratio of grain diameter to grain thickness of 5 to 10.

8. The silver halide photographic light-sensitive material as in claim 1, wherein said tabular grains occupy at least 70% of the entire projected area of all grains contained in said emulsion.

* * * * *